US007807915B2

(12) United States Patent
Kulkarni et al.

(10) Patent No.: US 7,807,915 B2
(45) Date of Patent: Oct. 5, 2010

(54) BANDWIDTH CONTROL FOR RETRIEVAL OF REFERENCE WAVEFORMS IN AN AUDIO DEVICE

(75) Inventors: Prajakt Kulkarni, San Diego, CA (US); Suresh Devalapalli, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 305 days.

(21) Appl. No.: 12/041,871

(22) Filed: Mar. 4, 2008

(65) Prior Publication Data

US 2008/0229913 A1 Sep. 25, 2008

Related U.S. Application Data

(60) Provisional application No. 60/896,438, filed on Mar. 22, 2007.

(51) Int. Cl.
*G10H 7/00* (2006.01)

(52) U.S. Cl. ..... 84/604; 84/602; 84/603; 84/609

(58) Field of Classification Search ..... None
See application file for complete search history.

(56) References Cited

U.S. PATENT DOCUMENTS 5,583,857 A * 12/1996 Soumiya et al. ..... 370/233
5,864,080 A 1/1999 O'Connell
7,038,119 B2 5/2006 Petef
7,045,700 B2 5/2006 Hamalainen et al.
7,285,712 B2 10/2007 Hsieh et al.
2003/0084144 A1* 5/2003 Lipinski ..... 709/224
2007/0071030 A1* 3/2007 Lee ..... 370/468
2007/0127489 A1* 6/2007 Amaya et al. ..... 370/395.2
2009/0030699 A1* 1/2009 Iser et al. ..... 704/500
2009/0034610 A1* 2/2009 Lee et al. ..... 375/240.02
2009/0048846 A1* 2/2009 Smaragdis et al. ..... 704/500
2009/0154380 A1* 6/2009 LeBlanc ..... 370/286
2009/0240509 A1* 9/2009 Song et al. ..... 704/500

FOREIGN PATENT DOCUMENTS

DE 10339032 5/2005
EP 1152394 11/2001
GB 2306043 4/1997

OTHER PUBLICATIONS

International Search Report—PCT/US08/057240—International Search Authority—European Patent Office—Jun. 30, 2008.
Written Opinion—PCT/US08/057240—International Search Authority—European Patent Office, Munich—Jun. 30, 2008.

* cited by examiner

*Primary Examiner*—Marlon T Fletcher
(74) *Attorney, Agent, or Firm*—Espartaco Diaz Hidalgo

(57) ABSTRACT

In general, the techniques of this disclosure may be used to control utilization of bandwidth allocated to an audio processing module. For example, to process various audio synthesis parameters, the audio processing module may retrieve reference waveform samples for use in generating audio information for voices within an audio frame, such as a MIDI frame. In some cases, the amount of bandwidth available for retrieving the reference waveforms from memory is limited. To manage the utilization of the allocated bandwidth a bandwidth control module estimates an amount of bandwidth required to retrieve reference waveforms for all the voices of the audio frame, and selects one or more voices to be eliminated from generated audio information when the bandwidth estimate exceeds the allocated bandwidth.

47 Claims, 4 Drawing Sheets

BANDWIDTH CONTROL FOR RETRIEVAL OF REFERENCE WAVEFORMS IN AN AUDIO DEVICE

RELATED APPLICATIONS

CLAIM OF PRIORITY UNDER 35 U.S.C. §119

The present Application for Patent claims priority to Provisional Application No. 60/896,438 entitled "BANDWIDTH CONTROL FOR RETRIEVAL OF REFERENCE WAVEFORMS IN AN AUDIO DEVICE" filed Mar. 22, 2007, and assigned to the assignee hereof and hereby expressly incorporated by reference herein.

TECHNICAL FIELD

This disclosure relates to electronic devices, and particularly to electronic devices that generate audio.

BACKGROUND

Musical Instrument Digital Interface (MIDI) is a format used in the creation, communication and/or playback of audio sounds, such as music, speech, tones, alerts, and the like. A device that supports the MIDI format playback may store sets of audio information that can be used to create various "voices." Each voice may correspond to one or more sounds, such as a musical note by a particular instrument. For example, a first voice may correspond to a middle C as played by a piano, a second voice may correspond to a middle C as played by a trombone, a third voice may correspond to a D# as played by a trombone, and so on. In order to replicate the musical note as played by a particular instrument, a MIDI compliant device may include a set of information for voices that specify various audio characteristics, such as the behavior of a low-frequency oscillator, effects such as vibrato, and a number of other audio characteristics that can affect the perception of sound. Almost any sound can be defined, conveyed in a MIDI file, and reproduced by a device that supports the MIDI format.

A device that supports the MIDI format may produce a musical note (or other sound) when an event occurs that indicates that the device should start producing the note. Similarly, the device stops producing the musical note when an event occurs that indicates that the device should stop producing the note. An entire musical composition may be coded in accordance with the MIDI format by specifying events that indicate when certain voices should start and stop. In this way, the musical composition may be stored and transmitted in a compact file format according to the MIDI format.

MIDI is supported in a wide variety of devices. For example, wireless communication devices, such as radiotelephones, may support MIDI files for downloadable sounds such as ringtones or other audio output. Digital music players, such as the "iPod" devices sold by Apple Computer, Inc and the "Zune" devices sold by Microsoft Corporation may also support MIDI file formats. Other devices that support the MIDI format may include various music synthesizers, wireless mobile devices, direct two-way communication devices (sometimes called walkie-talkies), network telephones, personal computers, desktop and laptop computers, workstations, satellite radio devices, intercom devices, radio broadcasting devices, hand-held gaming devices, circuit boards installed in devices, information kiosks, video game consoles, various computerized toys for children, on-board computers used in automobiles, watercraft and aircraft, and a wide variety of other devices.

SUMMARY

In general, this disclosure describes techniques for processing audio files. The techniques may be particularly useful for playback of audio files that comply with the musical instrument digital interface (MIDI) format, although the techniques may be useful with other audio formats, techniques or standards. As used herein, the term MIDI file refers to any file that contains at least one audio track that conforms to a MIDI format.

In particular, the techniques of this disclosure may be used to control utilization of bandwidth allocated to an audio processing module. For example, to process various audio synthesis parameters, the audio processing module may retrieve reference waveform samples for use in generating audio information for voices within an audio frame, such as a MIDI frame. In some cases, the amount of bandwidth available for retrieving the reference waveforms from memory is limited. The amount of bandwidth available for audio hardware unit to retrieve the reference waveforms may, for example, be limited based on the amount of bandwidth allocated to other components of the audio processing module. To manage the utilization of the allocated bandwidth a bandwidth control module estimates a bandwidth required to retrieve reference waveforms for all the voices of the audio frame, and selects one or more of the voices to be eliminated from generated audio information when the bandwidth estimate exceeds the allocated bandwidth in accordance with the techniques described herein.

In one aspect, a method comprises estimating a bandwidth required to retrieve reference waveforms used to generate audio information for voices within an audio frame and selecting one or more of the voices to be eliminated from generated audio information when the bandwidth estimate exceeds an allocated bandwidth.

In another aspect, a device comprises a bandwidth estimation module that estimates a bandwidth required to retrieve reference waveforms used to generate audio information for voices within an audio frame and a voice selection module that selects one or more of the voices to be eliminated from generated audio information when the bandwidth estimate exceeds an allocated bandwidth.

In a further aspect, a device comprises means for estimating a bandwidth required to retrieve reference waveforms used to generate audio information for voices within an audio frame from a memory and means for selecting one or more of the voices to be eliminated from generated audio information when the bandwidth estimate exceeds an allocated bandwidth.

In yet another aspect, a computer-readable medium comprises instructions that cause a programmable processor to estimate a bandwidth required to retrieve reference waveforms used to generate audio information for voices within an audio frame and select one or more of the voices to be eliminated from generated audio information when the bandwidth estimate exceeds an allocated bandwidth.

In another aspect, a device comprises a processor that executes software to parse an audio frame and schedule events associated with the audio frame, a digital signal processor (DSP) that processes the events and generates synthesis parameters, a hardware unit that generates audio information based on at least a portion of the synthesis parameters, and a memory unit. The DSP estimates an amount of bandwidth required by the hardware unit to retrieve reference waveforms used to generate audio information for voices within the audio frame and selects one or more of the voices to be eliminated from generated audio information when the bandwidth estimate exceeds an amount of bandwidth allocated to the hardware unit.

In another aspect, a circuit is configured to estimate a bandwidth required to retrieve reference waveforms used to generate audio information for voices within an audio frame, and select one or more of the voices to be eliminated from generated audio information when the bandwidth estimate exceeds an allocated bandwidth.

The details of one or more aspects of this disclosure are set forth in the accompanying drawings and the description below. Other features, objects, and advantages will be apparent from the description and drawings, and from the claims.

DETAILED DESCRIPTION

In general, this disclosure describes techniques for processing audio files. The techniques may be particularly useful for playback of audio files that comply with the musical instrument digital interface (MIDI) format, although the techniques may be useful with other audio formats, techniques or standards. As used herein, the term MIDI file refers to any file that contains at least one audio track that conforms to a MIDI format.

In particular the techniques of this disclosure may be used to control utilization of bandwidth allocated to an audio processing module. For example, to process various audio synthesis parameters, the audio processing module may retrieve reference waveform samples for use in generating audio information for voices within an audio frame, such as a MIDI frame. In some cases, the amount of bandwidth available for retrieving the reference waveforms from memory is limited. The amount of bandwidth available for audio hardware unit to retrieve the reference waveforms may, for example, be limited based on the amount of bandwidth allocated to other components of the audio processing module. To manage the utilization of the allocated bandwidth a bandwidth control module estimates a bandwidth required to retrieve reference waveforms for all the voices of the audio frame, and selects one or more of the voices to be eliminated from generated audio information when the estimated bandwidth exceeds the allocated bandwidth in accordance with the techniques described herein. In this manner, the selected voices are essentially dropped from the audio output to a human listener.

Figure 1:
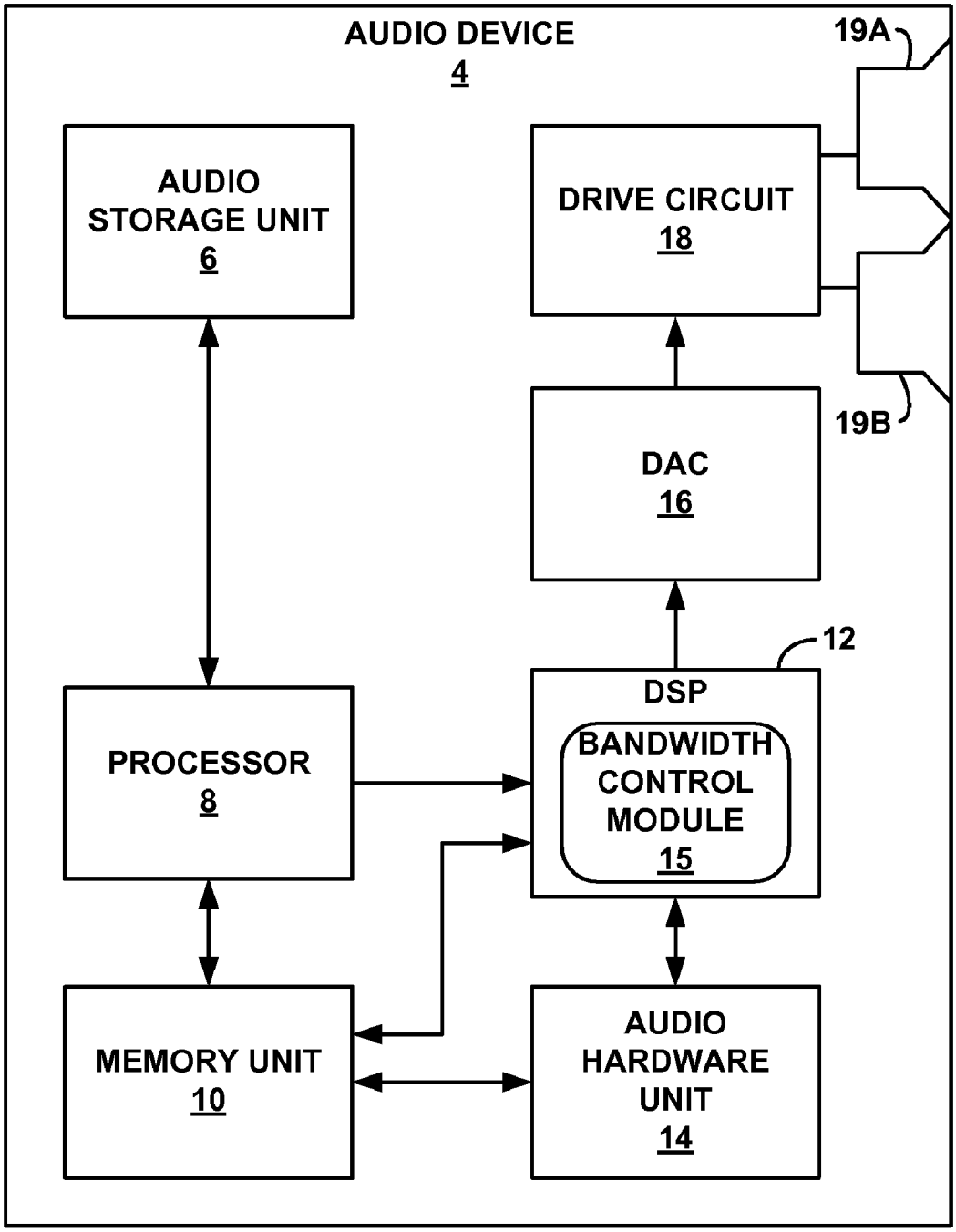
FIG. 1 is a block diagram illustrating an exemplary audio device that may implement the techniques of this disclosure.

FIG. 1 is a block diagram illustrating an exemplary audio device 4. Audio device 4 may comprise any device capable of processing MIDI files, e.g., files that include at least one MIDI track. Examples of audio device 4 include a wireless communication device such as a radiotelephone, a network telephone, a digital music player, a music synthesizer, a wireless mobile device, a direct two-way communication device (sometimes called a walkie-talkie), a personal computer, a desktop or laptop computer, a workstation, a satellite radio device, an intercom device, a radio broadcasting device, a hand-held gaming device, a circuit board installed in a device, a kiosk device, various computerized toys for children, a video game console, an on-board computer used in an automobile, watercraft or aircraft, or a wide variety of other devices. In addition, audio device 4 may be a musical instrument such as an electronic keyboard, drum machine, or other electronic musical instrument.

Audio device 4 includes an audio storage unit 6 that stores MIDI files. Audio storage unit 6 may additionally store other types of data. For example, if audio device 4 is a mobile telephone, audio storage unit 6 may store data that comprises a list of personal contacts, photographs and other types of data. Audio storage unit 6 may comprise any volatile or non-volatile memory or storage, such as a hard disk drive, a flash memory unit, a compact disc, a floppy disk, a digital versatile disc, a read-only memory (ROM), a random-access memory (RAM), or other information storage medium. Of course, audio storage unit 6 could also be a storage unit associated with a digital music player or a temporary storage unit associated with information transfer from another device. Audio storage unit 6 may be a separate volatile memory chip or non-volatile storage device coupled to processor 8 via a data bus or other connection.

Audio device 4 also includes a processor 8, a digital signal processor (DSP) 12 and an audio hardware audio hardware unit 14, that operate together to process MIDI files to generate audio information, such as a digital waveform of audio samples, based on the content of the MIDI files. In other words, processor 8, DSP 12 and audio hardware unit 14 may operate together to function as a synthesizer. In the example illustrated in FIG. 1, audio device 4 implements an architecture that separates MIDI processing tasks between processor 8, DSP 12 and audio hardware unit 14. Such separation of the MIDI processing tasks, however, is not necessary for implementation of the bandwidth control techniques described herein. Thus, in some implementations the processing tasks of processor 8, DSP 12 and audio hardware unit 14 may be combined into a single module. For example, the tasks associated with MIDI file processing can be delegated between two different threads of DSP 12 and audio hardware unit 14. That is to say, the tasks associated with the general purpose processor 8 (as described herein) could alternatively be executed by a first thread of a multi-threaded DSP, e.g., DSP 12. In this case, the first thread of DSP 12 executes the scheduling, a second thread of DSP 12 generates the synthesis parameters, and hardware unit 14 generates audio samples based on the synthesis parameters. DSP 12 may also include additional threads to perform other tasks, such as the bandwidth estimation techniques disclosed herein.

In one aspect, processor 8, DSP 12 and audio hardware unit 14 process MIDI files in an audio frame by audio frame manner. As used herein, the phrase "audio frame" refers to a block of time that may include several audio samples. As one example, an audio frame may correspond to a 10 millisecond (ms) interval that includes 480 samples for a device operating at a sampling rate of 48 kHz. Many events may correspond to one instance of time so that many voices or sounds can be included in one instance of time according to the MIDI format. Of course, the amount of time delegated to any audio frame, as well as the number of samples per frame may vary in different implementations.

Processor 8 may read data from and write data to audio storage unit 6. Furthermore, processor 8 may read data from and write data to a memory unit 10. For example, processor 8 may read MIDI files from audio storage module 6 and write MIDI files to memory unit 10. For each audio frame, processor 8 may retrieve one or more of the MIDI files and parse the MIDI files to extract one or more MIDI instructions. The MIDI instructions in the MIDI files may instruct a particular MIDI voice to start or stop. Other MIDI instructions may relate to aftertouch effects, breath control effects, program changes, pitch bend effects, control messages such as pan left or right, sustain pedal effects, main volume control, system messages such as timing parameters, MIDI control messages such as lighting effect cues, and/or other sound affects.

Based on these MIDI instructions, processor 8 schedules MIDI events associated with the MIDI files for processing by DSP 12. Processor 8 may provide the scheduling of MIDI events to memory unit 10 for access by DSP 12 so that DSP 12 can process the MIDI instructions. Alternatively, processor 8 may execute the scheduling by dispatching the MIDI instructions directly to DSP 12 in a time-synchronized manner. In particular, scheduling by processor 8 may include synchronization of timing associated with MIDI instructions, which can be identified based on timing parameters specified in the MIDI files.

DSP 12 processes the MIDI instructions according to the scheduling created by processor 8. In particular, DSP 12 may allocate new voices specified in the MIDI instructions as voices to start as well as drop voices specified in the MIDI instructions as voices to stop. In this manner, DSP 12 generates synthesis parameters that start and stop the new MIDI voices of the current audio frame. Moreover, DSP 12 may generate other synthesis parameters that describe various acoustic characteristics, such as level of resonance, pitch, reverberation, and volume, of the voices within the audio frame in accordance with the MIDI instructions.

In some cases, the amount of bandwidth available for retrieving the reference waveforms from memory unit 10 is limited. For example, the amount of bandwidth available for audio hardware unit 14 to access memory unit 10 may be a function of the amount of bandwidth allocated to processor 8 and DSP 12. To manage MIDI voices using wave-table synthesis when the amount of data that can be transferred per frame for wave-table lookup is limited DSP 12 includes a bandwidth control module 15 that implements the bandwidth control techniques of this disclosure. In particular, bandwidth control module 15 estimates an amount of bandwidth required to retrieve reference waveforms for all the voices of the audio frame. As described in more detail below, the reference waveforms are used to generate audio information, e.g., samples, for corresponding voices. In accordance with the techniques of this disclosure, bandwidth control module 15 selects one or more voices to be eliminated when the bandwidth estimate exceeds an amount of bandwidth allocated to audio hardware unit 14 for retrieval of reference waveforms from memory unit 10. Bandwidth control module 15 continues to select voices to be eliminated until the bandwidth estimate for retrieving reference waveforms is less than or equal to the amount of bandwidth allocated to audio hardware unit 14 for that purpose. In this manner, bandwidth control module 15 may recursively select voices to be eliminated until the estimated bandwidth is less than or equal to the allocated bandwidth. Alternatively, bandwidth control module 15 may determine the difference between the estimated and allocated bandwidth and select multiple voices with a total bandwidth that is greater than or equal to the difference between the estimated and allocated bandwidth. In this manner, bandwidth control module 15 may select multiple voices to be eliminated concurrently instead of selecting voices in a recursive manner.

As an example, the term "bandwidth" refers to the amount of data that can be transferred to audio hardware unit 14 per unit time, e.g., bytes per second. The bandwidth may be defined by the transmission medium between memory 10 and audio hardware unit, and possibly other factors, such as whether or not other components share the transmission medium for access to memory 10. For example, audio hardware unit 14 may have its own dedicated bus to memory 10, in which case, bandwidth may be defined by the number of bytes per second that can be transferred over the bus. Alternatively, audio hardware unit 14 may share a bus with DSP 12 and/or processor 8 for access to memory 10. In this case, the bandwidth may refer to the number of bytes per second that are currently allocated to audio hardware unit 14 over the shared bus. If a shared bus is used, the bandwidth may be determined by a bus controller or other component that regulates information transfer over a shared bus. Furthermore, if a shared bus is used, the bandwidth allocated to audio hardware unit 14 may change at different times depending on the amount of bandwidth needed by other components that use the same bus. In any case, given a fixed amount of bandwidth at any given instance, the techniques of this disclosure can facilitate a desirable control over the voices, and possible elimination of the least important voices in a manner that promotes a desirable audio experience.

In FIG. 1, the arrow between audio hardware unit 14 and memory unit 10 may represent a dedicated bus, or alternatively, the different arrows between memory unit 10 and processor 8, between memory unit 10 and DSP 12, and between memory unit 10 and audio hardware unit 14 may collectively represent a shared bus. The dedicated or shared bus may be controlled by a bus controller (not shown), which may determine the bandwidth to audio hardware unit 14 at any given instance.

As described in more detail below, bandwidth control module 15 attempts to select the least significant voices in the audio frame. The level of acoustical significance of a MIDI voice in an audio frame may be a function of the importance of that MIDI voice to the overall sound perceived by a human listener of the audio frame. Bandwidth control module 15 may, for example, select one or more voices with the lowest amplitude, voices that have been active or turned on for the longest period of time, or voices that are associated with a lowest priority MIDI channel. Moreover, bandwidth control module 15 may analyze other synthesis parameters associated with the voices when selecting which voice to be eliminated, such as a state of an ADSR envelope, a type of instrument corresponding to the voice, and the like. ADSR stands for "attack delay sustain release." The foregoing techniques may be implemented individually, or two or more of such techniques, or all of such techniques, may be implemented together in bandwidth control module 15.

DSP 12 may store the MIDI synthesis parameters of the unselected voices in memory unit 10. In this case, audio hardware unit 14 may access memory unit 10 to obtain the synthesis parameters. Alternatively, DSP 12 may provide the synthesis parameters of the unselected voices directly to audio hardware unit 14, e.g., setting one or more registers within audio hardware unit 14. Thus, audio hardware unit 14 does not receive synthesis parameters for the selected voices. Thus, the voices selected to be eliminated are essentially dropped from the audio frame. In this manner, DSP 12 controls bandwidth requirements of audio hardware unit 14 to ensure that the bandwidth requirements for retrieving reference waveforms does not exceed the allocated bandwidth of audio hardware unit 14.

Audio hardware unit 14 generates a digital waveform that comprises a number of audio samples for each audio frame using the synthesis parameters generated by DSP 12. The digital waveform generated by audio hardware unit 14 may, for example, comprise a pulse-code modulation (PCM) signal, which is a digital representation of an analog signal that is sampled at regular intervals. To generate the digital waveform for an individual audio frame, audio hardware unit 14 may generate digital waveforms for each of the MIDI voices in the audio frame. To generate a digital waveform for a MIDI voice, audio hardware unit 14 may retrieve a reference waveform, often referred to as a "wave-table," associated with the MIDI voice from memory unit 10. Audio hardware unit 14 varies one or more parameters, e.g., pitch, amplitude, or other acoustic characteristic, of the reference waveform in accordance with the synthesis parameters to generate the digital waveform for the MIDI voice. Audio hardware unit 14 sums the digital waveforms generated for each of the MIDI voices to calculate the digital waveform for the audio frame. Additional details of exemplary audio generation by audio hardware unit 14 are discussed below with reference to FIG. 2.

After generating the digital waveform for the audio frame, audio hardware unit 14 may deliver the generated digital waveform back to DSP 12, e.g., via interrupt-driven techniques. In this case, DSP 12 may also perform post-processing techniques on the digital waveform. The post processing may include filtering, scaling, volume adjustment, or a wide variety of audio post processing that may ultimately enhance the sound output. Following the post processing, DSP 12 may output the post processed digital waveform to digital-to analog converter (DAC) 16. DAC 16 converts the digital waveform into an analog signal and outputs the analog signal to a drive circuit 18. Drive circuit 18 may amplify the signal to drive one or more speakers 19A and 19B to create audible sound. Audio device 4 may include one or more additional components (not shown) including filters, pre-amplifiers, amplifiers, and other types of components that prepare the analog signal for output by speakers 19.

In some implementations, the described techniques can be pipelined for improved efficiency in the processing of MIDI files. In particular, the processing performed by audio hardware unit 14 with respect to an audio frame N+2, occurs simultaneously with synthesis parameter generation by DSP 12 with respect to an audio frame N+1, and scheduling operations by processor 8 with respect to an audio frame N. Such a pipelined technique can improve efficiency and possibly reduce the computational resources needed for given stages, such as those associated with the DSP.

Processor 8 may comprise any of a wide variety of general purpose single- or multi-chip microprocessors. Processor 8 may implement a Complex instruction Set Computer (CISC) design or a Reduced Instruction Set Computer (RISC) design. Generally, processor 8 comprises a central processing unit (CPU) that executes software. Examples include 16-bit, 32-bit or 64-bit microprocessors from companies such as Intel Corporation, Apple Computer, Inc, Sun Microsystems Inc., Advanced Micro Devices (AMD) Inc., ARM Inc. and the like. Other examples include Unix- or Linux-based microprocessors from companies such as International Business Machines (IBM) Corporation, RedHat Inc., and the like. DSP 12 may comprise the QDSP4 DSP developed by Qualcomm Inc. audio hardware unit 14 may be implemented as a hardware component of audio device 4. For example, audio hardware unit 14 may be a chipset embedded into a circuit board of audio device 4.

Although the bandwidth control techniques are described in FIG. 1 as being performed within DSP 12, the bandwidth control techniques may alternatively be performed within other modules of audio device 4. For example, audio hardware unit 14 may implement the bandwidth control techniques. In this case, audio hardware unit 14 receives synthesis parameters for all of the voices of the frame and selects voices to be eliminated when the estimated bandwidth necessary for retrieving reference waveforms from memory unit 10 exceeds the amount of bandwidth allocated to audio hardware unit 14. Moreover, although the techniques of this disclosure are described in the context of MIDI, the techniques are applicable for synthesizing digital waveforms for other formats used in the creation, communication and/or playback of audio sounds.

The various components illustrated in FIG. 1 are illustrated for exemplary purposes to explain aspects of this disclosure. The features illustrated in FIG. 1 may be realized by any suitable combination of hardware, software components, or a combination thereof. However, other components may exist in some implementations. For example, if audio device 4 is a radiotelephone, then an antenna, transmitter, receiver and modulator-demodulator ("modem") may be included to facilitate wireless communication of audio files. Moreover, some of the illustrated components may not be included in other implementations.

Figure 2:
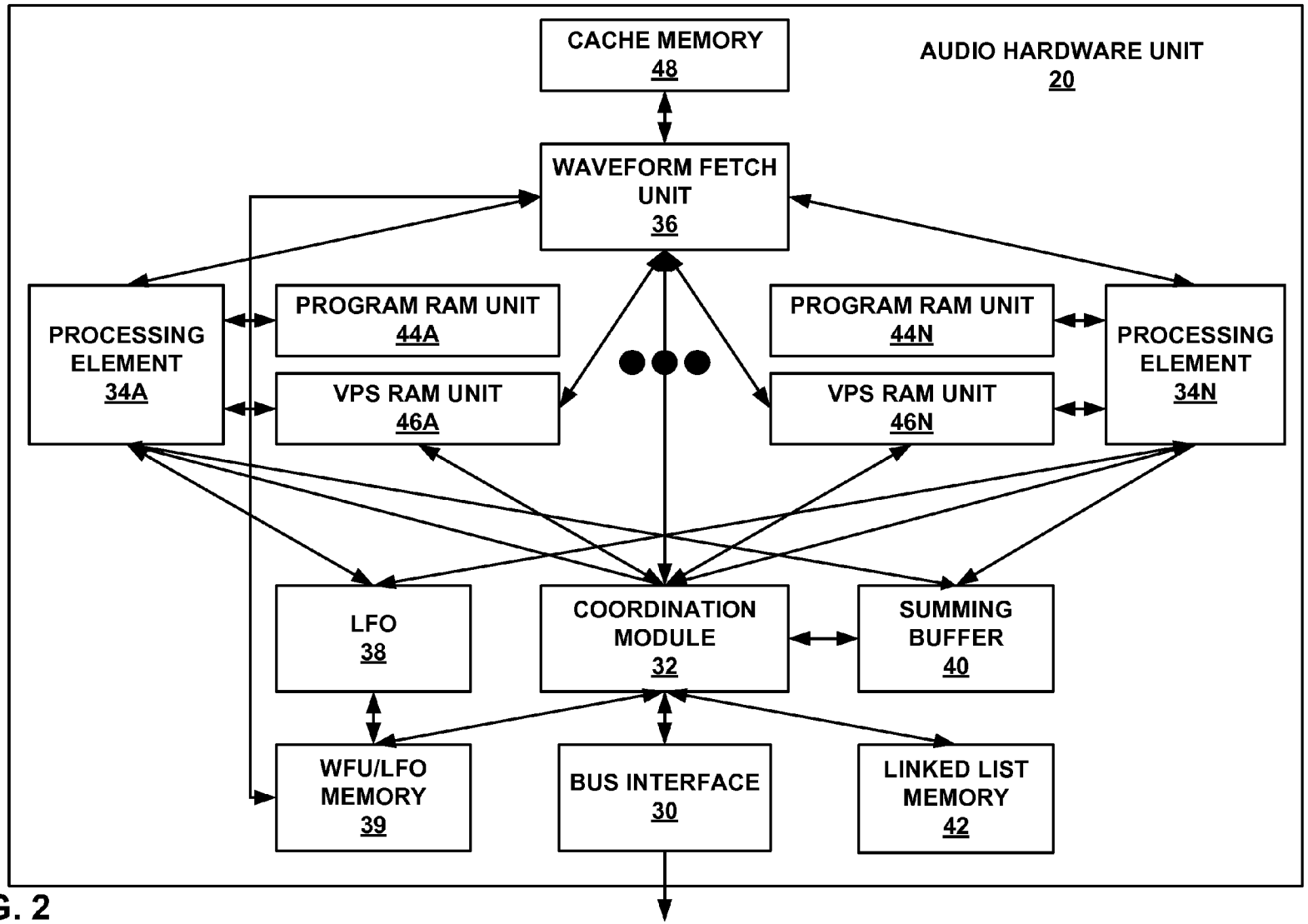
FIG. 2 is a block diagram illustrating an exemplary audio hardware unit for use in an audio device.

FIG. 2 is a block diagram illustrating an exemplary audio hardware unit 20 for use in an audio device. Audio hardware unit 20 may represent audio hardware unit 14 of audio device 4 (FIG. 1). The implementation shown in FIG. 2 is merely exemplary as other hardware implementations could also be defined consistent with the teaching of this disclosure. As illustrated in the example of FIG. 2, audio hardware unit 20 includes a bus interface 30 to send and receive data. Audio hardware unit 20 may utilize bus interface 30 to send data to and receive data from DSP 12. Additionally, audio hardware unit 20 may retrieve data from memory unit 10. To accomplish such actions, bus interface 30 may include an AMBA High-performance Bus (AHB) master interface, an AHB slave interface, and a memory bus interface. AMBA stands for advanced microprocessor bus architecture. Alternatively, bus interface 30 may include an AXI bus interface, or another type of bus interface. AXI stands for advanced extensible interface.

Audio hardware unit 20 may include a coordination module 32. Coordination module 32 coordinates data flows within audio hardware unit 20. Additionally, coordination module 32 may coordinate data flows between audio hardware unit 20 and DSP 12 or memory unit 10. Coordination module 32 may, for example, coordinate the transfer of synthesis parameters for the voices of an audio frame from DSP 12. As described above, DSP 12 may estimate an amount of bandwidth required by audio hardware unit 20 to retrieve reference waveforms for all the voices of the audio frame, and select one or more voices to be eliminated from generated audio when the bandwidth estimate exceeds an amount of bandwidth allocated to audio hardware unit 20 for retrieval of reference waveforms from memory unit 10. In this case, audio hardware unit 20 only receives synthesis parameters for the unselected voices, thereby essentially dropping the selected voices from the audio frame.

In another aspect, however, the bandwidth control techniques of this disclosure may be implemented within audio hardware unit 20. In particular, audio hardware unit 20 may receive synthesis parameters for all the voices of the audio frame and select the voices to be eliminated from generated audio information to satisfy the allocated bandwidth. For example, control module 32 may estimate an amount of bandwidth required by audio hardware unit 20 to retrieve reference waveforms for all the voices of the audio frame, and select one or more voices to be eliminated when the bandwidth estimate exceeds an amount of bandwidth allocated to audio hardware unit 20 for retrieval of reference waveforms from memory unit 10. To this end, coordination module 32 may include a bandwidth control module (not shown in FIG. 2).

When audio hardware unit 20 receives an instruction from DSP 12 (FIG. 1) to begin synthesizing an audio frame, coordination module 32 reads the synthesis parameters for the unselected voices of audio frame. Audio hardware unit 20 generates a digital waveform for the unselected voices of audio frame using the synthesis parameters. Because synthesis parameters associated with the selected voices were not received, audio hardware unit 20 does not generate audio information for those voices. In other words, the selected voices are essentially dropped from the audio frame. The synthesis parameters describe various acoustic characteristics of one or more MIDI voices within a given frame, such as a level of resonance, pitch, reverberation, volume, and/or other characteristics that can affect one or more voices. Audio hardware unit 20 may load the synthesis parameters directly from DSP 12 to a memory module 42 within audio hardware unit 20, or retrieve them from memory 10 via data pointers to locations in memory unit 10. In particular, at the direction of coordination module 32, synthesis parameters may be loaded from memory unit 10 into voice parameter set (VPS) RAM 46A or 46N associated with a respective processing element 34A or 34N. At the direction of DSP 12 (FIG. 1), program instructions are loaded from memory 10 into program RAM units 44A or 44N associated with a respective processing element 34A or 34N.

After coordination module 32 reads the list of synthesis parameters, coordination module 32 may retrieve a plurality of reference waveforms associated with the unselected voices from memory unit 10. For example, coordination module 32 may retrieve the reference waveforms needed to generate the samples for each of the voices. Coordination module 32 may store the retrieved reference waveforms in WFO/LFO memory 39.

The instructions loaded into program RAM unit 44A or 44B instruct the associated processing elements 34A or 34N to synthesize voices one of the voices indicated in the list of synthesis parameters in VPS RAM unit 46A or 46N. There may be any number of processing elements 34, and each may comprise one or more arithmetic logic units (ALUs) or other units that are capable of performing mathematical operations, as well as reading and writing data. Only two processing elements 34A and 34N are illustrated for simplicity, but many more may be included in hardware unit 20. Processing elements 34 may synthesize voices in parallel with one another. In particular, the plurality of different processing elements 34 work in parallel to process different synthesis parameters associated with different voices. In other words, each of the processing elements synthesizes one of the voices indicated in the list of synthesis parameters. In this manner, a plurality processing elements 34 within audio hardware unit 20 can accelerate and possibly increase the number of generated voices thereby improving the generation of audio samples.

When coordination module 32 instructs one of processing elements 34 to synthesize a voice, the respective processing element may execute one or more instructions associated with the synthesis parameters. Again, these instructions may be loaded into program RAM unit 44A or 44N. The instructions loaded into program RAM unit 44A or 44N cause the respective one of processing elements 34 to perform voice synthesis. For example, processing elements 34 may send requests to a waveform fetch unit (WFU) 36 to obtain a reference waveforms for the MIDI voices specified in the synthesis parameters. Each of processing elements 34 may use WFU 36. An arbitration scheme may be used to resolve any conflicts if two or more processing elements 34 request use of WFU 36 at the same time.

In response to a request from one of processing elements 34, WFU 36 returns the reference waveform specified by the synthesis parameters. WFU 36 may return a reference waveform that was stored within a cache memory 48, within WFU/LFU memory 39 or within memory unit 10. The reference waveform returned by WFU 36 includes one or more samples that are provided to the requesting processing element 34. Because a wave can be phase shifted within a sample, e.g., by up to one cycle of the wave, WFU 36 may return two samples in order to compensate for the phase shifting using interpolation. Furthermore, because a stereo signal may include two separate waves for the two stereophonic channels, WFU 36 may return separate samples for different channels, e.g., resulting in up to four separate samples for stereo output.

After WFU 36 returns the reference waveform to one of processing elements 34, the respective processing element may execute additional program instructions based on the synthesis parameters. In particular, instructions cause one of processing elements 34 to request an asymmetric triangular waveform from a low frequency oscillator (LFO) 38 in audio hardware unit 20. By multiplying the reference waveform returned by WFU 36 with the triangular waveform returned by LFO 38, the respective processing element 34 may manipulate various acoustic characteristics of the waveform to achieve a desired audio affect. For example, multiplying a waveform by a triangular wave may result in a waveform that sounds more like a desired musical instrument.

Other instructions executed based on the synthesis parameters may cause a respective one of processing elements 34 to loop the waveform a specific number of times, adjust the amplitude of the waveform, add reverberation, add a vibrato effect, or cause other acoustical effects. In this way, processing elements 34 can calculate a digital waveform for a MIDI voice that lasts one audio frame. Eventually, a respective processing element 34 may encounter an exit instruction. When one of processing elements 34 encounters an exit instruction, that processing element signals the end of voice synthesis to coordination module 32. The calculated voice waveform can be provided to a summing buffer 40 at the direction of another store instruction during the execution of the program instructions. This causes summing buffer 40 to store that calculated voice waveform.

When summing buffer 40 receives a calculated waveform from one of processing elements 34, summing buffer 40 adds the calculated waveform to the proper instance of time associated with an overall waveform for the audio frame. Thus, summing buffer 40 combines output of the plurality of processing elements 34. For example, summing buffer 40 may initially store a flat wave (i.e., a wave where all digital samples are zero.) When summing buffer 40 receives a calculated waveform associated with a particular MIDI voice from one of processing elements 34, summing buffer 40 can add each digital sample of the calculated waveform to respective samples of the waveform stored in summing buffer 40. In this way, summing buffer 40 accumulates the calculated waveforms associated with the plurality of MIDI voices and stores an overall digital representation of a waveform for a full audio frame. Summing buffer 40 essentially sums the different instances of time associated with different generated voices from different ones of processing elements 34 in order to create a digital waveform representative of an overall audio compilation within a given audio frame.

Eventually, coordination module 32 may determine that processing elements 34 have completed synthesizing all of the voices required for the current audio frame and have provided those voices to summing buffer 40. At this point, summing buffer 40 contains digital samples indicative of a completed waveform for the current audio frame. When coordination module 32 makes this determination, coordination module 32 sends an interrupt to DSP 12 (FIG. 1). In response to the interrupt, DSP 12 may send a request to a control unit in summing buffer 40 (not shown) to receive the content of summing buffer 40, e.g., via direct memory exchange (DME). Alternatively, DSP 12 may also be pre-programmed to perform the DME. DSP 12 may then perform any post processing on the digital waveform, before providing the digital waveform to DAC 16 for conversion into the analog domain. The processing performed by audio hardware unit 20 with respect to a frame N+2, occurs simultaneously with synthesis parameter generation by DSP 12 respect to a frame N+1, and scheduling operations by processor 8 (FIG. 1) respect to a frame N.

Cache memory 48, WFU/LFO memory 39 and linked list memory 42 are also shown in FIG. 2. Cache memory 48 may be used by WFU 36 to fetch base waveforms in a quick and efficient manner. WFU/LFO memory 39 may be used by coordination module 32 to store voice parameters of the voice parameter set or one or more reference waveforms. In this way, WFU/LFO memory 39 can be viewed as memories dedicated to the operation of waveform fetch unit 36 and LFO 38. Linked list memory 42 may comprise a memory used to store a list of voice indicators generated by DSP 12. The voice indicators may comprise pointers to one or more synthesis parameters stored in memory 10. Each voice indicator in the list may specify the memory location that stores a voice parameter set for a respective MIDI voice. The various components and arrangements of components (including memories) shown in FIG. 2 are purely exemplary. The techniques described herein could be implemented with a variety of other arrangements.

Figure 3:
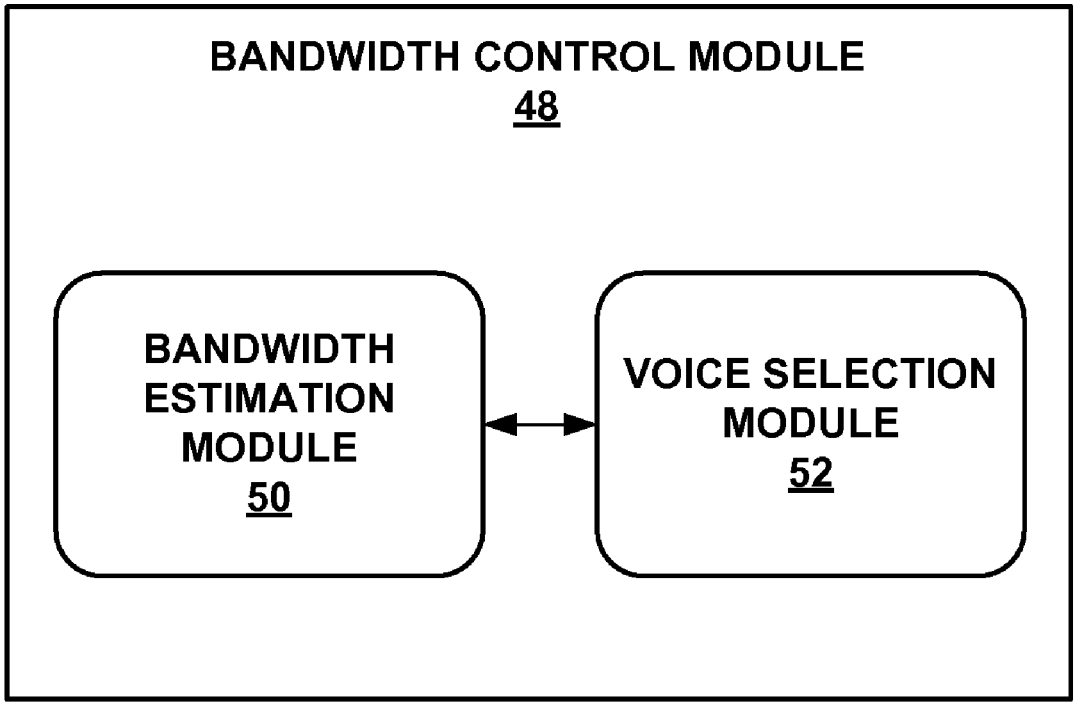
FIG. 3 is a block diagram illustrating an exemplary bandwidth control module.

FIG. 3 is a block diagram illustrating an exemplary bandwidth control module 48. Bandwidth control module 48 may represent bandwidth control module 15 of audio device 4 (FIG. 1). As illustrated in FIG. 3, bandwidth control module 48 includes a bandwidth estimation module 50 and a voice selection module 52 that function together to implement the bandwidth control techniques described herein.

In particular, bandwidth estimation module 50 estimates, for each audio frame, the amount of bandwidth needed by audio hardware unit 14 to retrieve reference waveforms for the MIDI voices of that particular frame from memory unit 10. As described above, the amount of bandwidth available for transfer of the reference waveforms associated with the MIDI voices may vary from audio frame to audio frame. For example, the amount of bandwidth allocated for retrieving reference waveforms in memory unit 10 may vary as a function of the amount of memory bandwidth allocated to other components of audio device 4, such as the bandwidth allocations to processor 8 and DSP 12. Moreover, the amount of bandwidth allocated for accessing reference waveforms in memory unit 10 may also vary based on the memory bandwidth allocated to other modules within audio hardware unit 14.

Bandwidth estimation module 50 may, for example, estimate the bandwidth requirements of audio hardware unit 14 for the current frame based on the number of samples of the reference waveforms that audio hardware unit 14 needs to retrieve from memory unit 10. In other words, bandwidth estimation module 50 estimates the bandwidth requirements of audio hardware unit 14 on a frame by frame basis. As a starting point, bandwidth estimation module 50 may estimate the bandwidth requirements of audio hardware unit 14 based on the number of samples of the reference waveform. To more accurately estimate the bandwidth requirements of audio hardware unit 14, however, bandwidth estimation module 50 may utilize one or more of the bandwidth estimation techniques described herein.

In a first bandwidth estimation technique, bandwidth estimation module 50 may determine a playback position for each of the voices of the audio frame and estimate the bandwidth requirements based on the playback position. One type of reference waveform, referred to as a looped waveform, is divided into two sections; a transient section and loop section. An audio device plays the transient section once through and then the plays the loop section repetitively until the note ends. The playback position refers to the position along the waveform corresponding to that particular audio frame. Bandwidth estimation module 50 may determine whether the playback positions associated with the voices of the audio frame are in the transient or loop section and determine that it is only necessary to retrieve the loop section of the looped reference waveform when the playback position lies within the loop section. Thus, bandwidth estimation module 50 may estimate the bandwidth required to retrieve the reference waveform as the number of samples of the looped section of the reference waveform. When the playback position lies within the transient section of the reference waveform, however, bandwidth estimation module 50 determines that audio hardware unit 14 likely retrieves the entire reference waveform and uses that determination in estimating the bandwidth requirements of audio hardware unit 14. For one-shot sounds, i.e., sounds that are not segmented into a transient portion and loop portion, bandwidth estimation module 50 may determine that audio hardware unit 14 must retrieve the entire reference waveform.

In another bandwidth estimation technique, bandwidth estimation module 50 determines that only a portion the reference waveform needs to retrieved and uses that determination in estimating the bandwidth requirements of audio hardware unit 14. For example, bandwidth estimation module 50 may compute the difference between a waveform sample index associated with a beginning of the audio frame and a waveform sample index associated with an end of the audio frame. Bandwidth estimation module 50 may compare the difference between the start and end waveform sample indices with the number of samples in the reference waveform. If the difference between the start and end waveform sample indices is less than the number of samples in the waveform, bandwidth estimation module 50 determines that the audio hardware unit 14 need only retrieve the portion of the reference waveform from the sample index associated with the beginning of the frame and the sample index associated with the end of the frame. If the waveform sample index associated with the end of the frame, however, is greater than the total number of samples of a looped waveform, bandwidth estimation module 50 determines that rolling over will take place during that frame. Rolling over causes bandwidth estimation module 50 to re-compute the index from the start of the loop portion of the waveform. Thus, bandwidth estimation module may determine that the entire waveform should be transferred to audio hardware unit 14, or at least the entire loop portion of the waveform Bandwidth estimation module 50 compares the estimated bandwidth needed to retrieve the reference waveforms for the MIDI voices with the amount of bandwidth allocated for retrieval of reference waveforms from memory unit 10. As described above, the amount of bandwidth allocated to retrieving the reference waveforms may vary each frame. Upon determining that the estimated bandwidth requirements of audio hardware unit 14 exceeds the allocated bandwidth, voice selection module 52 selects one or more MIDI voices to be eliminated from generated audio. Voice selection module 52 may attempt to select the voice that is the least perceptually relevant voice in the frame. Voice selection module 52 may, for example, select the voice with the lowest amplitude envelope and thus the least perceptually audible voice. Alternatively, or additionally, voice selection module 52 may select the voice that has been active or turned on for the longest period of time, i.e., the oldest note. For example, voice selection module 52 may analyze frame counters associated with each voice that count the number of consecutive frames that the voice has been active, and select the voice that has been active for the most consecutive frames. In some MIDI specifications, such as SP-MIDI, audio channels are assigned priority values. In this case, voice selection module 52 may select a voice or voices associated with a lowest priority audio channel as the voice or voices to be eliminated from the generated audio information.

In addition to analyzing the amplitude, active length, or priority associated with the voices, voice selection module 52 may analyze other synthesis parameters associated with the voices in making its selection. As one example, voice selection module 52 may analyze a state of an ADSR envelope, and only select voices that are not in an attack state. Typically, notes that are in the attack state are more perceptually audible to a human listener than notes in other states. Instead, voice selection module 52 only selects voices that are in a decay state, sustain state or release state. As another example, voice selection module 52 may analyze the type of instrument associated with each of the voices and select a less perceptually relevant instrument for removal. Voice selection module 52 may, for instance, attempt to avoid selecting a voice corresponding to a percussion instrument because percussion instruments tend to be more perceptually noticeable in a song.

Moreover, voice selection module 52 may select additional voices to be eliminated based on the previously selected voice. For example, some voices belong to a layered note, i.e., a note that includes a plurality of voices. If voice selection module 52 initially selects a voice that belongs to a layered note, then voice selection module 52 may select the other voices of that note to be eliminated from the generated audio information. This is because by removing one of voices of the layered note likely will result in a different sounding note anyway.

The foregoing techniques may be implemented individually, or two or more of such techniques, or all of such techniques, may be implemented together in bandwidth control module 48. Moreover, as described above, bandwidth control module 48 may be implemented within any of the modules of audio device 4 (FIG. 1). In one aspect, bandwidth control module 48 may be implemented within DSP 12 (FIG. 1). In this case, audio hardware unit 20 (FIG. 1) only receives synthesis parameters for the unselected voices. In another aspect, bandwidth control module 48 may be implemented within audio hardware unit 14. In this case, audio hardware unit 14 receives synthesis parameters for all of the voices of the frame and selects the one or more voices to be eliminated when the estimated bandwidth necessary for retrieving reference waveforms from memory unit 10 exceeds the amount of bandwidth allocated to audio hardware unit 14.

The various components illustrated in FIG. 3 may be realized in hardware, software, firmware, or any combination thereof Some components may be realized as processes or modules executed by one or more microprocessors or digital signal processors (DSPs), one or more application specific integrated circuits (ASICs), one or more field programmable gate arrays (FPGAs), or other equivalent integrated or discrete logic circuitry. Depiction of different features as modules is intended to highlight different functional aspects of bandwidth control module 48 and does not necessarily imply that such modules must be realized by separate hardware or software components. Rather, functionality associated with one or more modules may be integrated within common or separate hardware or software components. Thus, the disclosure should not be limited to the example of bandwidth control module 48.

When implemented in software, the functionality ascribed to the systems and devices described in this disclosure may be embodied as instructions on a computer-readable medium, such as within a memory (not shown), which may comprise, for example, random access memory (RAM), read-only memory (ROM), non-volatile random access memory (NVRAM), electrically erasable programmable read-only memory (EEPROM), FLASH memory, magnetic or optical data storage media, or the like. The instructions are executed to support one or more aspects of the functionality described in this disclosure.

Figure 4:
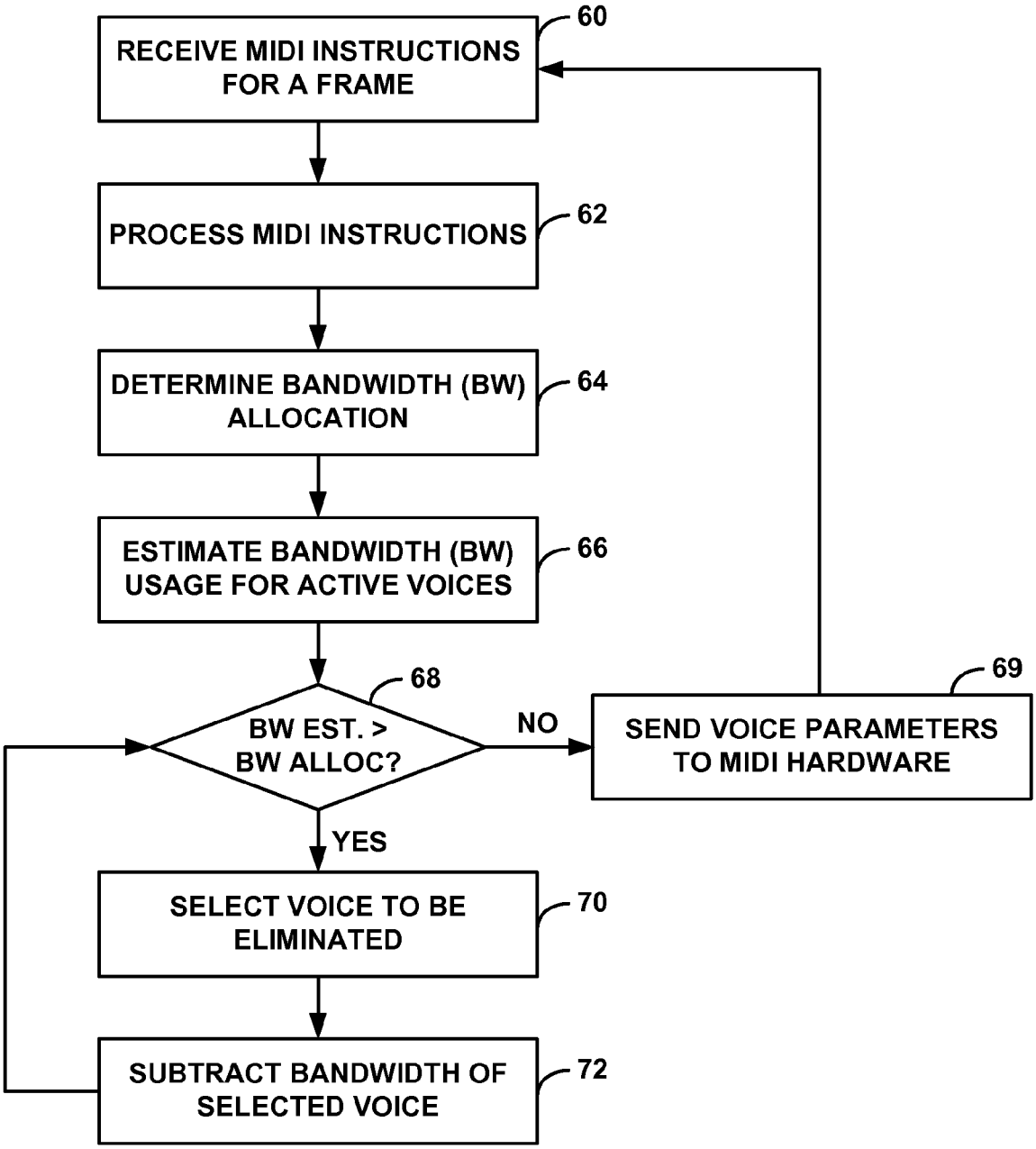
FIG. 4 is a flow diagram illustrating exemplary operation of an audio device implementing the bandwidth control techniques of this disclosure.

FIG. 4 is a flow diagram illustrating exemplary operation of a synthesis device, such as audio device 4 of FIG. 1, implementing the bandwidth control techniques of this disclosure. For exemplary purposes, the exemplary operation of the synthesis device is described as being performed within DSP 12. As described above, however, the bandwidth control techniques may alternatively be performed within other modules of audio device 4, such as within audio hardware unit 14.

Initially DSP 12 receives one or more MIDI instructions associated with MIDI files of an audio frame (60). As described above, DSP 12 may receive the MIDI instructions from processor 8 in a time-synchronized manner. Alternatively, processor 8 may write the MIDI instructions to local memory 10 and DSP 12 may access memory 10 to retrieve the instructions for processing. The MIDI instructions may instruct a particular MIDI voice to start or stop. Other MIDI instructions may relate to aftertouch effects, breath control effects, program changes, pitch bend effects, control messages such as pan left or right, sustain pedal effects, main volume control, system messages such as timing parameters, MIDI control messages such as lighting effect cues, and/or other sound affects.

DSP 12 processes the MIDI instructions received from processor 8 (62). In particular, DSP 12 may allocate new voices and delete voices that have expired leases in accordance with the MIDI instructions that indicate the start or stop of a voice. Moreover, DSP 12 may generate synthesis parameters for each of the notes according to the MIDI instructions.

DSP 12 determines the amount of bandwidth allocated for retrieving reference waveforms from memory unit 10 (64). As described above, the amount of bandwidth available for transfer of the reference waveforms associated with the MIDI voices may vary from audio frame to audio frame. For example, the amount of bandwidth allocated for retrieving reference waveforms in memory unit 10 may vary as a function of the amount of memory bandwidth allocated to other components of audio device 4, such as the bandwidth allocations to processor 8 and DSP 12. Moreover, the amount of bandwidth allocated for accessing reference waveforms in memory unit 10 may also vary based on the memory bandwidth allocated to other modules within audio hardware unit 14.

DSP 12 estimates the amount of bandwidth needed by audio hardware unit 14 to retrieve reference waveforms for the MIDI voices of the frame from memory unit 10 (64). Bandwidth estimation module 50 may, for example, estimate the bandwidth requirements of audio hardware unit 14 for the current frame based on the number of samples of the reference waveforms that audio hardware unit 14 needs to retrieve from memory unit 10. As a starting point, bandwidth estimation module 50 may estimate the bandwidth requirements of audio hardware unit 14 based on the number of samples contained in the reference waveform.

To more accurately estimate the bandwidth requirements of audio hardware unit 14, however, bandwidth estimation module 50 may utilize one or more of the bandwidth estimation techniques described herein. In a looped reference waveform, for example, bandwidth estimation module 50 may determine whether a playback position associated with the voices of the audio frame are in the transient or loop section of corresponding reference waveforms and determine that it is only necessary to retrieve the loop section of the looped reference waveform when the playback position lies within the loop section. When the playback position lies within the transient section of the looped reference waveform, however, bandwidth estimation module 50 determines that audio hardware unit 14 may require retrieval of the entire reference waveform and uses that determination in estimating the bandwidth requirements of audio hardware unit 14. Moreover, for one-shot sounds, i.e., sounds that are not segmented into a transient portion and loop portion, bandwidth estimation module 50 may determine that audio hardware unit 14 may require retrieval of the entire reference waveform.

As another example, audio hardware unit 14 may compute the difference between a waveform sample index associated with a beginning of the audio frame and a waveform sample index associated with an end of the audio frame. Bandwidth estimation module 50 may compare the difference between the start and end waveform sample indices with the number of samples in the reference waveform. If the difference between the start and end waveform sample indices is less than the number of samples in the waveform, bandwidth estimation module 50 determines that the audio hardware unit 14 need only retrieve the portion of the reference waveform from the sample index associated with the beginning of the frame and the sample index associated with the end of the frame.

DSP 12 determines whether the estimated bandwidth needed to retrieve the reference waveforms for the MIDI voices is greater than the amount of bandwidth allocated for retrieval of reference waveforms (68). If the estimated bandwidth needed to retrieve the reference waveforms for the MIDI voices is less than or equal to the amount of bandwidth allocated for retrieval of reference waveforms, DSP 12 sends the synthesis parameters for the voices to 14 for synthesis (69).

If the estimated bandwidth needed to retrieve the reference waveforms for the MIDI voices is greater than the amount of bandwidth allocated for retrieval of reference waveforms, DSP 12 selects at least one voice to be eliminated from generated audio information (70). Voice selection module 52 may attempt to select the least perceptually relevant voice in the frame. Voice selection module 52 may, for example, select the voice with the lowest amplitude envelope using the heuristic that the lowest amplitude voice is the least perceptually audible voice. Alternatively, or additionally, voice selection module 52 may select the voice that has been active or turned on for the longest period of time, i.e., the oldest note. For example, voice selection module 52 may analyze frame counters associated with each voice that count the number of consecutive frames that the voice has been active, and select the voice that has been active for the most consecutive frames. In some MIDI specifications, such as SP-MIDI, channels are assigned priority values. In this case, voice selection module 52 may select a voice or voices associated with channel with the lowest priority value as the voice or voices to be eliminated.

In addition to analyzing the amplitude, active length, or priority associated with the voices, voice selection module 52 may analyze other synthesis parameters associated with the voices in making its selection. As one example, voice selection module 52 may analyze a state of an ADSR envelope, and only select voices that are not in an attack state. Typically, notes that are in the attack state are more perceptually audible to a human listener than notes in other states. Instead, voice selection module 52 only selects voices that are in a decay state, sustain state or release state. As another example, voice selection module 52 may analyze the type of instrument associated with each of the voices and select a less perceptually relevant instrument for removal. Voice selection module 52 may, for instance, attempt to avoid selecting voices corresponding to percussion instruments because percussion instruments tend to be more perceptually noticeable to a human listener.

Moreover, voice selection module 52 may select additional voices to be eliminated based on the previously selected voice. For example, some voices belong to a layered note, i.e., a note that includes a plurality of voices. If voice selection module 52 initially selects a voice that belongs to a layered note, then voice selection module 52 may select other voices of that note to be eliminated. This is because by removing one of voices of the layered note likely will result in a different sounding note anyway.

After selecting the voice to be eliminated, DSP 12 subtracts the bandwidth needed to retrieve the reference waveform for the selected voice from the estimated bandwidth (72). In other words, DSP 12 subtracts the bandwidth required by the selected voice from the original bandwidth estimate. In this manner, DSP 12 recomputes the bandwidth required to retrieve the reference waveforms for the unselected voices of the audio frame. DSP 12 then compares the recomputed bandwidth requirement with the amount of bandwidth allocated for retrieval of reference waveforms. DSP 12 continues to select voices until the estimated bandwidth needed for retrieval of the waveforms is less than or the amount of bandwidth allocated for retrieval of reference waveforms. By not sending the synthesis parameters associated with the selected voices to audio hardware unit 14, DSP 12 controls the amount of bandwidth used by audio hardware unit 14 to retrieve reference waveforms.

Various examples have been described. One or more aspects of the techniques described herein may be implemented in hardware, software, firmware, or combinations thereof. Any features described as modules or components may be implemented together in an integrated logic device or separately as discrete but interoperable logic devices. If implemented in software, one or more aspects of the techniques may be realized at least in part by a computer-readable medium comprising instructions that, when executed, performs one or more of the methods described above. The computer-readable data storage medium may form part of a computer program product, which may include packaging materials. The computer-readable medium may comprise random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates code in the form of instructions or data structures and that can be accessed, read, and/or executed by a computer.

The instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated software modules or hardware modules configured or adapted to perform the techniques of this disclosure.

If implemented in hardware, one or more aspects of this disclosure may be directed to a circuit, such as an integrated circuit, chipset, ASIC, FPGA, logic, or various combinations thereof configured or adapted to perform one or more of the techniques described herein. The circuit may include both the processor and one or more hardware units, as described herein, in an integrated circuit or chipset.

It should also be noted that a person having ordinary skill in the art will recognize that a circuit may implement some or all of the functions described above. There may be one circuit that implements all the functions, or there may also be multiple sections of a circuit that implement the functions. With current mobile platform technologies, an integrated circuit may comprise at least one DSP, and at least one Advanced Reduced Instruction Set Computer (RISC) Machine (ARM) processor to control and/or communicate to DSP or DSPs. Furthermore, a circuit may be designed or implemented in several sections, and in some cases, sections may be re-used to perform the different functions described in this disclosure.

Various aspects and examples have been described. However, modifications can be made to the structure or techniques of this disclosure without departing from the scope of the following claims. For example, other types of devices could also implement the MIDI processing techniques described herein. These and other aspects of this disclosure are within the scope of the following claims.

The invention claimed is:

1. A method comprising:

estimating a bandwidth required to retrieve, from a memory, reference waveforms used by an audio hardware unit to generate audio information for voices within an audio frame;

selecting one or more of the voices to be eliminated from generated audio information when the bandwidth estimate exceeds an allocated bandwidth;

retrieving one or more of the reference waveforms from the memory without retrieving reference waveforms associated with the one or more of the voices selected to be eliminated; and generating the audio information via the audio hardware unit using the retrieved reference waveforms.

2. The method of claim 1, wherein selecting one or more of the voices to be eliminated comprises selecting at least one of the voices that has a lowest amplitude.

3. The method of claim 1, wherein selecting one or more of the voices to be eliminated comprises selecting at least one of the voices that has been turned on for a longest period of time.

4. The method of claim 1, further comprising:

determining whether the selected voices correspond to a note that has multiple layers of voices; and selecting one or more of the voices of other layers of the multi-layer note corresponding to any of the selected voices to be eliminated.

5. The method of claim 1, further comprising:

analyzing priority values associated with a plurality of audio channels corresponding to the voices of the audio frame, wherein selecting one or more of the voices to be eliminated comprises selecting one or more voices associated with the audio channel corresponding to the lowest one of the priority values.

6. The method of claim 1, further comprising:

determining a state of an ADSR envelope associated with each of the voices, wherein selecting one or more of the voices to be eliminated comprises selecting one or more voices that are not in an attack state of the corresponding ADSR envelope.

7. The method of claim 1, further comprising:

determining a type of instrument corresponding to each of the voices, wherein selecting one or more of the voices to be eliminated comprises selecting one or more voices that do not correspond to a percussion instrument.

8. The method of claim 1, further comprising:

recomputing the bandwidth estimate for the unselected voices; and selecting one or more additional voices to be eliminated when the recomputed bandwidth estimate exceeds the allocated bandwidth.

9. The method of claim 8, wherein recomputing the bandwidth estimate comprises subtracting a bandwidth estimate associated with the selected voices from the bandwidth estimate for the audio frame.

10. The method of claim 1, wherein estimating the bandwidth comprises estimating a total number of samples of the reference waveforms corresponding to the voices of the audio frame.

11. The method of claim 1, wherein estimating the bandwidth required to retrieve the reference waveforms comprises:

determining a playback position for each of the voices of the audio frame; and estimating the bandwidth required to retrieve the reference waveforms as the number of samples of looped sections of the reference waveforms for voices in which the corresponding playback position is within the looped sections of the associated reference waveforms.

12. The method of claim 1, wherein estimating the bandwidth required to retrieve the reference waveforms comprises:

computing, for each of the voices, a difference between a waveform sample index associated with the voice at a beginning of the audio frame and a waveform sample index associated with the voice at an end of the audio frame;

comparing the differences with a total number of samples in respective reference waveforms associated with the voices; and estimating the bandwidth required to retrieve each of the reference waveforms associated with the voices as the number of samples between the waveform sample index associated with the respective voice at the beginning of the audio frame and the waveform sample index associated with the respective voice at the end of the audio frame when the corresponding difference is less than the total number of samples.

13. The method of claim 1, wherein estimating the bandwidth required to retrieve reference waveforms comprises estimating, within a digital signal processor (DSP), a bandwidth required by the audio hardware unit to retrieve the reference waveforms from a memory, and further comprising:

receiving, within the audio hardware unit, synthesis parameters associated with the unselected voices when the bandwidth estimate is less than or equal to the allocated bandwidth; and generating, within the audio hardware unit, audio information using the received synthesis parameters.

14. The method of claim 13, further comprising passing the audio hardware unit synthesis parameters for the unselecting voices.

15. A device comprising:

a memory that stores reference waveforms used to generate audio information for voices within an audio frame;

a bandwidth estimation module that estimates a bandwidth required to retrieve the reference waveforms from the memory;

a voice selection module that selects one or more of the voices to be eliminated from generated audio information when the bandwidth estimate exceeds an allocated bandwidth; and an audio unit that retrieves one or more of the reference waveforms from the memory without retrieving reference waveforms associated with the one or more of the voices selected to be eliminated, and generates the audio information using the retrieved reference waveforms.

16. The device of claim 15, wherein the voice selection module selects at least one of the voices that has a lowest amplitude.

17. The device of claim 15, wherein the voice selection module selects at least one of the voices that has been turned on for a longest period of time as the voice to be eliminated.

18. The device of claim 15, wherein the voice selection module determines whether the selected voices correspond to a note that has multiple layers of voices and selects one or more of the voices associated with other layers of the note corresponding to any of the selected voices to be eliminated.

19. The device of claim 15, wherein the voice selection module analyzes priority values associated with a plurality of audio channels corresponding to the voices of the audio frame and selects one or more of the voices associated with the one of the audio channels corresponding to the lowest one of the priority values.

20. The device of claim 15, wherein the voice selection module determines a state of an ADSR envelope associated with each of the voices and selects one or more of the voices that are not in an attack state of the corresponding ADSR envelope.

21. The device of claim 15, wherein the voice selection module determines a type of instrument corresponding to each of the voices and selects one or more of the voices that do not correspond to a percussion instrument.

22. The device of claim 15, wherein:

the bandwidth estimation module recomputes the bandwidth estimate for the unselected voices; and the voice selection module selects one or more additional voices to be eliminated when the recomputed bandwidth estimate exceeds the allocated bandwidth.

23. The device of claim 22, wherein the bandwidth estimation module subtracts a bandwidth estimate associated with the selected voices from the bandwidth estimate to recompute the bandwidth estimate.

24. The device of claim 15, wherein the bandwidth estimation module estimates a total number of samples of the reference waveforms for the voices of the audio frame.

25. The device of claim 15, wherein the bandwidth estimation module determines, for each of the voices, a playback position and estimates the bandwidth required to retrieve the reference waveform associated with each the voices as the number of samples of a looped section of the respective reference waveform for voices in which the playback position is within the looped sections of the respective reference waveforms.

26. The device of claim 15, wherein the bandwidth estimation module computes, for each of the voices, a difference between a waveform sample index associated with each of the voices at a beginning of the audio frame and a waveform sample index associated with each of the voices at an end of the audio frame, compares each of the differences with a total number of samples in the respective reference waveforms, and estimates the bandwidth required to retrieve each of the reference waveforms as the number of samples between the waveform sample index associated with the respective voice at the beginning of the audio frame and the waveform sample index associated with the respective voice at the end of the audio frame when the corresponding difference is less than the total number of samples.

27. The device of claim 15, further comprising:

a processor that executes software to parse the audio frame and schedule events associated with the audio frame;

a digital signal processor (DSP) that processes the events and generates synthesis parameters; and a hardware unit that generates audio information based on the synthesis parameters wherein the audio unit is the hardware unit.

28. The device of claim 27, wherein the bandwidth estimation module and the voice selection module are implemented within the DSP to control the bandwidth required by the hardware unit to retrieve the reference waveforms from a memory.

29. The device of claim 28, wherein the DSP provides synthesis parameters to the hardware unit for the unselected voices.

30. The device of claim 27, wherein the bandwidth estimation module and the voice selection module are implemented within the hardware unit to control the bandwidth utilized by the hardware unit to retrieve the reference waveforms from a memory.

31. The device of claim 27, wherein the processor, the DSP and the hardware unit operate in a pipelined manner.

32. The device of claim 15, further comprising:

a multi-threaded digital signal processor (DSP) including a first thread that parses musical instrument digital interface (MIDI) files and schedules MIDI events associated with the MIDI files, a second thread that processes the MIDI events and generates MIDI synthesis parameters, and a third thread that implements the bandwidth estimation module and the voice selection module; and a hardware unit that generates audio samples based on the synthesis parameters, wherein the audio unit is the hardware unit.

33. The device of claim 15, wherein the audio frame comprises a musical instrument digital interface (MIDI) frame.

34. A device comprising:

means for estimating a bandwidth required to retrieve from a memory, reference waveforms used to generate audio information for voices within an audio frame from a memory;

means for selecting one or more of the voices to be eliminated from generated audio information when the bandwidth estimate exceeds an allocated bandwidth means for retrieving one or more of the reference waveforms from the memory without retrieving reference waveforms associated with the one or more of the voices selected to be eliminated; and means for generating the audio information using the retrieved reference waveforms.

35. The device of claim 34, wherein the voice selection means selects one of:

at least one of the voices that has a lowest amplitude, at least one of the voices that has been turned on for a longest period of time, and at least one of the voices associated with an audio channel corresponding to a lowest priority value.

36. The device of claim 34, further comprising:

means for determining a state of an ADSR envelope associated with each of the voices, wherein the voice selection means selects one or more of the voices that are not in an attack state of the corresponding ADSR envelope.

37. The device of claim 34, further comprising:

means for determining a type of instrument corresponding to each of the voices, wherein the voice selection means selects one or more of the voices that do not correspond to a percussion instrument.

38. The device of claim 34, wherein:

the estimating means recomputes the bandwidth estimate for the unselected voices; and the voice selection means selects one or more additional voices to be eliminated when the recomputed bandwidth estimate exceeds the allocated bandwidth.

39. The device of claim 34, wherein the bandwidth estimation means determines a playback position for each of the voices of the audio frame and estimates the bandwidth required to retrieve the reference waveforms as the number of samples of looped sections of the reference waveforms for voices in which the playback positions are within the looped sections.

40. The device of claim 34, further comprising:

means for computing, for each of the voices, a difference between a waveform sample index associated with the voice at a beginning of the audio frame and a waveform sample index associated with the voice at an end of the audio frame; and means for comparing the differences with a total number of samples in respective reference waveforms associated with the voices;

wherein the estimation means estimates the bandwidth required to retrieve each of the reference waveforms associated with the voices as the number of samples between the waveform sample index associated with the respective voice at the beginning of the audio frame and the waveform sample index associated with the respective voice at the end of the audio frame when the corresponding difference is less than the total number of samples.

41. The device of claim 34, further comprising:

software means for parsing the audio frame and scheduling events associated with the audio frame;

firmware means for processing the events to generate synthesis parameters; and hardware means for generating audio samples based on the synthesis parameters, wherein the hardware means comprises the means for generating the audio information, wherein the firmware means includes:

the estimating means to estimate the bandwidth required by the hardware means to retrieve the reference waveforms for the voices within the audio frame from a memory, and the voice selection means that selects one or more of the voices to be eliminated when the bandwidth estimate exceeds bandwidth allocated to the hardware means.

42. A computer-readable medium comprising instructions that cause a processor to:

estimate a bandwidth required to retrieve from a memory, reference waveforms used to generate audio information for voices within an audio frame;

select one or more of the voices to be eliminated from generated audio information when the bandwidth estimate exceeds an allocated bandwidth;

retrieve one or more of the reference waveforms from the memory without retrieving reference waveforms associated with the one or more of the voices selected to be eliminated; and generate the audio information using the retrieved reference waveforms.

43. The computer-readable medium of claim 42, further comprising instructions that cause the processor to provide synthesis parameters to a hardware unit for the unselected voices.

44. A device comprising:

a processor that executes software to parse an audio frame and schedule events associated with the audio frame;

a digital signal processor (DSP) that processes the events and generates synthesis parameters;

a hardware unit that generates audio information based on at least a portion of the synthesis parameters; and a memory unit, wherein the DSP estimates an amount of bandwidth required by the hardware unit to retrieve from the memory unit, reference waveforms used to generate audio information for voices within the audio frame and selects one or more of the voices to be eliminated from generated audio information when the bandwidth estimate exceeds an amount of bandwidth allocated to the hardware unit, wherein the hardware unit retrieves one or more of the reference waveforms from the memory without retrieving reference waveforms associated with the one or more of the voices selected to be eliminated, and generates the audio information using the retrieved reference waveforms.

45. The device of claim 44, wherein the DSP provides the synthesis parameters associated with the unselected voices to the hardware unit.

46. A circuit configured to:

estimate a bandwidth required to retrieve from a memory, reference waveforms used by an audio unit to generate audio information for voices within an audio frame;

select one or more of the voices to be eliminated from generated audio information when the bandwidth estimate exceeds an allocated bandwidth;

retrieve one or more of the reference waveforms from the memory without retrieving reference waveforms associated with the one or more of the voices selected to be eliminated; and generate the audio information via the audio unit using the retrieved reference waveforms.

47. The circuit claim 46, the circuit being configured to provide synthesis parameters to a hardware unit for the unselected voices, wherein the hardware unit is the audio unit.

* * * * *